US005813266A

United States Patent [19]

Ash

[11] Patent Number: 5,813,266

[45] Date of Patent: Sep. 29, 1998

[54] METHOD OF FORMING AND PIERCING A TUBE

[75] Inventor: Stanley P. Ash, Greenville, Mich.

[73] Assignee: Greenville Tool & Die Company, Greenville, Mich.

[21] Appl. No.: 763,826

[22] Filed: Dec. 11, 1996

Related U.S. Application Data

[63] Continuation-in-part of Ser. No. 550,711, Oct. 31, 1995, Pat. No. 5,630,334.

[51] Int. Cl.[6] ..... B21D 9/15; B21D 26/02

[52] U.S. Cl. ..... 72/57; 72/58; 72/61; 29/421.1

[58] Field of Search ..... 72/57, 58, 61, 72/62; 29/421.1

[56] References Cited

U.S. PATENT DOCUMENTS

| | | | |
|---|---|---|---|
| 203,842 | 5/1878 | LeLand . | |
| 567,518 | 9/1896 | Simmons | 72/57 |
| 3,105,537 | 10/1963 | Foster | 72/58 |
| 3,546,917 | 12/1970 | Gardner et al. . | |
| 3,739,615 | 6/1973 | Tressel | 72/58 |
| 3,864,150 | 2/1975 | Baird et al. . | |
| 4,564,226 | 1/1986 | Doherty, Jr. | 72/56 |
| 4,744,237 | 5/1988 | Cudini | 72/61 |
| 4,754,535 | 7/1988 | Valtiero | 72/465 |
| 4,829,803 | 5/1989 | Cudini | 72/61 |
| 5,070,717 | 12/1991 | Boyd et al. | 72/57 |
| 5,333,775 | 8/1994 | Bruggemann et al. | 72/61 |
| 5,339,667 | 8/1994 | Shah et al. | 72/58 |
| 5,353,618 | 10/1994 | Roper et al. | 72/58 |
| 5,363,544 | 11/1994 | Wells et al. | 72/58 |
| 5,415,021 | 5/1995 | Folmer | 72/58 |
| 5,431,326 | 7/1995 | Ni et al. | 72/61 |
| 5,481,892 | 1/1996 | Roper et al. | 72/61 |
| 5,485,737 | 1/1996 | Dickerson | 72/57 |
| 5,557,961 | 9/1996 | Ni et al. | 72/61 |
| 5,630,334 | 5/1997 | Ash | 72/58 |

FOREIGN PATENT DOCUMENTS

| | | |
|---|---|---|
| 892976A | 10/1982 | Belgium . |
| 57-142724 | 9/1982 | Japan . |
| 60-064733 | 4/1985 | Japan . |
| 838550 | 6/1960 | United Kingdom . |
| 9420234 | 9/1994 | WIPO . |

OTHER PUBLICATIONS

*Cerro Alloy Physical Data –Applications*, Cerro Metal Products.

*Bending Thin–Walled Tubing, Moldings and Extruded Shapes*, Cerro Metal Products.

Sanjay Shah et al., *Tube Hydroforming: Process Capability and Production Application*, Body Assembly & Manufacturing Proceedings, Internal Body Engineering Conference (Sep. 1994).

William L. Christensen, *Hydroforming of Tubular Sections*, Metal Forming (Oct. 1995).

*Primary Examiner*—David Jones

*Attorney, Agent, or Firm*—Warner Norcross & Judd LLP

[57] ABSTRACT

A metal tube is cold formed into a stamped member by filling the tube with a liquid change-of-state material, freezing the change-of-state material, sealing the tube containing the solid change-of-state material, and stamping the tube in a die. The change-of-state material compresses during the stamping step to force the walls of the tube to conform to the die cavity, eliminating the need to pressurize the tube prior or subsequent to stamping. Additionally, the solid within the tube provides support to the wall of the tube during a piercing step to form a hole in the tube having less deformation surrounding the hole than a comparative tube pierced without having the solid fill. After the stamping or piercing steps, the change-of-state material is melted and drained from the tube. Further, a tube is pierced by forming an outwardly bulged area and piercing the tube in the outwardly bulged area while sinultaneously depressing the tube to substantially flatten the outwardly bulged area.

17 Claims, 8 Drawing Sheets

METHOD OF FORMING AND PIERCING A TUBE

This appplication is a continuation-in-part of application No. 08/550,711 filed Oct. 31, 1995, now U.S. Pat. No. 5,630,334.

BACKGROUND OF THE INVENTION

The present invention relates to forming and piercing tubular materials, and more particularly to cold forming and piercing tubular materials to produce structural members.

Tube hydroforming is a known method of cold forming metal tubes to create structural members, for example, for the automotive industry. In a typical hydroforming process, a tube is partially deformed by stamping it in a die. Then, internal hydraulic pressure exceeding the yield strength of the tube wall is applied to force the tube to expand and to conform to the die cavity—much like blowing up a balloon. Several references discuss hydroforming methods. These references include U.S. Pat. Nos. 5,339,667 issued Aug. 23, 1994 to Shah et al., entitled "Method for Pinch Free Tube Forming"; 5,070,717 issued Dec. 10, 1991 to Boyd et al., entitled "Method of Forming a Tubular Member with Flange"; and 4,744,237 issued May 17, 1988 to Cudini, entitled "Method of Forming Box-Like Frame Members"; and Sanjay Shah et al., *Tube Hydroforming: Process Capability and Production Applications,* Body Assembly & Manufacturing Proceedings, International Body Engineering Conference (Sept. 1994).

Hydroforming processes offer several advantages over conventional die-stamping processes for cold forming metal tubes. These advantages include reduced variation in the finished pieces, reduced number of steps needed to produce the finished pieces, improved structural integrity of the finished pieces, and eliminated need to join separately pressed parts by welding. However, hydroforming has the disadvantage of requiring expensive and specialized die machinery to handle the extreme pressures to which the tube must be exposed. In particular, hydroforming requires additional machinery external to the die, such as pumps and intensifiers, to boost the internal hydraulic pressure of the tube. Further, the high pressures required for hydrofonning can be dangerous to machine operators.

Several variations of the hydroforming process exist. For example, U.S. Pat. No. 4,829,803 issued May 16, 1989 to Cudini, entitled "Method of Forming Box-Like Frame Members" discloses a step of hydraulically pressurizing the internal space of a tube prior to closing the die, to allow better control of the deformation of the tube wall during die closure. The pressure to which the tube is initially pressurized, typically about 300 p.s.i.g., is selected to be less than the yield limit of the tube wall, but high enough so that during die closure (i.e., stamping), as the upper and lower die sections compress the tube, the tube walls are forced evenly toward the corners of the die cavity. More specifically, as the die closes, the hydraulic pressure within the tube causes the tube wall to overcome the frictional forces tending to resist the tube wall's transverse slippage over the surface of the upper and lower die sections. Thus, the internal pressure is selected so that the tube wall slides over the surface of the die sections and avoids being pinched between the upper and lower die sections as they mate.

To assure that the internal tube pressure during the '803 process does not rise to cause yielding of the tube wall during die stamping, a pressure relief valve is positioned in one end of the tube, set to release the liquid at a pressure below the yield limit of the tube. However, since the tube wall at the completion of this stamping process is bowed or dished inwardly, the '803 process requires a final hydroforming step of applying internal pressure to exceed the yield limit of the tube wall, and to expand the tube to conform to the die cavity. Thus, the '803 process does not escape the disadvantages of the hydroforming process. Rather, the '803 process adds an initial pressurization step to the hydroforming process, thereby slowing the tube forming process and increasing the cost of hydroforming.

Another variant of the tube hydroforming process is described in U.S. Pat. No. 5,353,618 issued Oct. 11, 1994 to Roper et al., entitled "Apparatus and Method for Forming a Tubular Frame Member," which discloses hydraulically pressurizing the interior of a tube to just below its burst pressure (yield strength) prior to bending and die stamping the tube, in order to ensure uniform, non-buckling deformation of the tube. A pressure relief valve and a hydraulic pressure source act in concert to maintain the internal pressure within the tube at just below the tube's burst pressure during the bending and stamping steps.

In utilizing the '618 process, if the cross-sectional perimeter of the preformed tube is, in some areas of the tube, less than the cross-sectional perimeter of the die cavity, then the tube must be expanded into the small radiused corners of the die cavity by subsequent hydroforming. However, if the cross-sectional perimeter of the die cavity is approximately equal to the cross-sectional perimeter of the preformed tube, then the tube will conform to the die cavity without subsequent hydroforming if the internal tube pressure prior to die stamping is near, yet less than, the internal burst pressure of the tube. (See Col. 18, Ins. 7–33.)

The '618 process has several disadvantages. The requirement that the tube be internally pressurized prior to die stamping adds a step that increases the complexity of the tube forming process, and increases the amount of equipment needed to complete the process. Further, subjecting the tube to high pressures prior to stamping requires a step that slows the forming process and therefore increases the cost of tube forming. Also, pressurizing a tube prior to stamping it decreases the safety of the stamping operation. A fmal disadvantage of the '618 process is the limitation that the internal pressure of the tube during the die stamping step remain below the yield strength (i.e., burst pressure) of the tube wall. This limitation ultimately requires an additional hydroforming step to expand the tube if the cross-sectional perimeter of the die cavity is greater than the preformed tube circumference.

It is known in the unrelated field of pipe bending that increasing the internal hydrostatic pressure of a pipe can help to prevent buckling or wrinkling of the pipe wall when bending the pipe. See, for example, U.S. Pat. Nos. 3,105,537 issued Oct. 1, 1963 to Foster, entitled "Bending Pipe"; 567,518 issued Sep. 8, 1896 to Simmons, entitled "Mechanism for Bending Pipe"; and 203,842 issued May 21, 1878 to Leland, entitled "Method of Bending Plumbers' Traps." The elevated hydrostatic pressures, although lower than hydroforming pressures, suffer the same disadvantages noted above. Further, the express purpose of pipe bending is to maintain the same cross-sectional roundness following bending.

It is also known in the unrelated field of bending pipes or tubes to fill the tube with liquid lead or lead-bismuth alloy and allow the metal to solidify prior to bending the tube in order to prevent the tube wall from buckling, collapsing, or wrinkling during the bending process. After bending, the metal-filled tube is heated to melt and drain the filling. See, for example, *Bending Thin-Walled Tubing, Moldings and Extruded Shapes* published by Cerro Metal Products Company. Again, the express purpose of the tube-bending application is to prevent the distortion of the tube cross-section while bending the tube. Further, the use of a liquid metal fill when bending pipe or tubes presents the disadvantageous necessities: (1) cleaning and oiling the tube interior prior to filling the tube with the liquid metal, (2) cleaning the tube interior—frequently by chemical means—after draining the melted metal filling, (3) preventing the metal filling from oxidizing when melting it, and (4) preventing the metal filling from reacting with or sticking to the tube material. These additional steps are labor intensive and therefore expensive.

Holes are typically made in formed metal sheet by a punch process. To allow a clean pierce and prevent distortion of the metal area surrounding the hole, a "die button" is used to back up the metal sheet while the punch pierces the metal sheet. However, in formed, bent tubes, it is difficult to provide a back-up during the punch process. The geometry of the bent tube may prevent access to the tube interior in order to provide back up. For example, back-up of a punch operation is difficult if the formed tube has more than one bend along its axis or if the area to be punched is a substantial distance (e.g., more than about 12 inches) from the tube end. Further, bending a tube having holes can unacceptably distort the holes.

High-pressure liquid in the interior of a tube can provide support when piercing the tube. However, as with hydroforming, this method requires additional expense and equipment to boost the internal hydraulic pressure of the tube.

In the unrelated field of casting, it is known to prepare low-melting-point mandrels for use in the fabrication of high-melting-point structures. After casting, the cast unit is heated to melt and drain the mandrel. See, for example, U.S. Pat. No. 3,864,150 to Baird et al entitled "Reusable Mandrel for Structures Having Zero Draft or Re-Entrant Geometries" issued Feb. 4, 1975.

SUMMARY OF THE INVENTION

The aforementioned problems are overcome in the present invention wherein a solid-filled tube is die-stamped to cold form the tube to a non-cylindrical shape. More specifically, the process includes the following steps. First, a tube is filled with a liquid change-of-state material having a melting point lower than the melting point of the tube. Second, the liquid change-of-state material is frozen to form a solid-filled tube. Third, the solid-filled tube is sealed. Fourth, the solid-filled tube is stamped in a die to form a stamped member. Finally, the change-of-state material within the stamped member is melted and drained from the formed, stamped member.

Preferably, the change-of-state material comprises water. Also preferably, a portion of the change-of-state material within the solid-filled tube is released during the stamping step. Still also preferably, a bulk member is inserted in the tube prior to freezing the change-of-state material within the tube.

In another embodiment of the present invention, a hole is formed in a tube by punching a solid-filled tube. More specifically, the method requires the following steps: First, a tube is filled with a liquid change-of-state material having a melting point lower than the melting point of the tube. Second, the liquid change-of-state material is frozen to form a solid-filled tube. Third, the solid-filled tube is pierced to create a pierced tube defining a hole. Finally, the change-of-state material is melted and drained from the pierced tube.

The pierced solid-filed tube has less deformation surrounding the hole formed by the pierce than a comparative tube pierced without a change-of-state solid filling.

In still another embodiment of the present invention, a tube is punched in an outwardly bulged area to define a hole. More specifically, the method requires the following steps: First, a tube is formed to have an outwardly bulged area. Second, the formed tube is pierced in the outwardly bulged area to define a hole. Simultaneously to the piercing step, the outwardly bulged area is depressed. The outwardly bulged area is substantially flattened. Further, the pierced tube has less deformation surrounding the hole than a comparative tube pierced without having first formed an outwardly bulged area.

Preferably, the method further includes compressing the outwardly bulged area subsequent to the simultaneous depressing and piercing steps.

The present invention eliminates the need to elevate the internal pressure of the tube prior to die stamping the tube. Further, the invention does not require hydroforming; that is, it does not require an additional step of elevating the internal pressure of the tube after die stamping in order to conform the walls of the stamped tube to the walls of the die cavity. Thus, the method of the present invention permits cold forming a tube with a minimal number of process steps, while retaining the previously discussed advantages of hydroforming, and avoiding the previously discussed disadvantages of a pre-forming pressurization step or a post-stamping hydroforming step. Further, the method of the present invention allows an extremely fast production rate of cold-formed metal tubes. Also, the method of the present invention does not require a specialized die or press—the method can be used with standard mechanical or hydraulic dies or presses that have a sufficient size and tonnage capacity.

Further, the method of the present invention can use water as a change-of-state fill material, thus avoiding the disadvantages attendant to the use of metallic alloys as change-of-state fill materials, as previously discussed in association with the unrelated field of pipe bending.

Also, the present invention provides an effective method for piercing a tube to form a hole while minimizing the amount of deformation surrounding the hole. The method can be used to pierce a tube in locations along the tube for which back-up is difficult to provide with conventional punch processes.

These and other objects, advantages, and features of the invention will be more readily understood and appreciated by reference to the detailed description of the preferred embodiment and the drawings.

DETAILED DESCRIPTION OF THE PREFERRED EMBODIMENT

I. Die Stamping and Piercing an Empty Tube (Prior Art)

Figure 1:
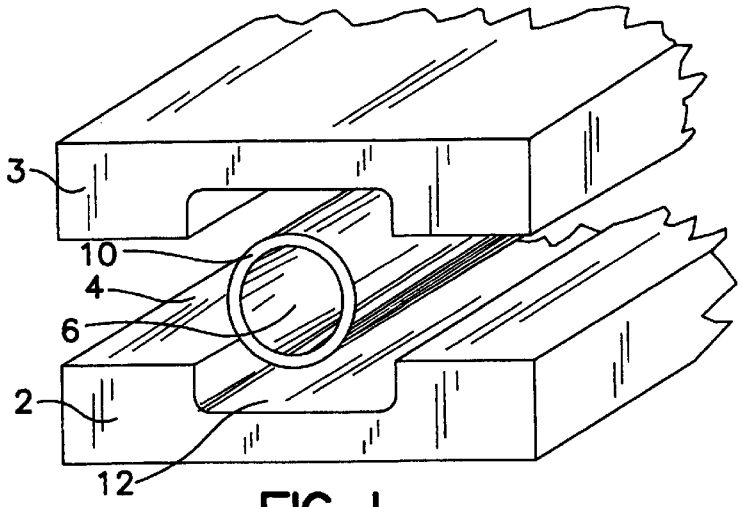
FIG. 1 PRIOR ART
FIG. 1 is a perspective view of a prior art stamping method showing conventional die in an open position.

FIG. 1 shows a perspective view of a conventional die with lower and upper die sections 2 and 3. Tube 4 is placed between lower and upper die sections 2 and 3 prior to stamping or mating of the dies. Tube 4 does not contain any liquid or solid in the tube interior 6.

Figure 2:
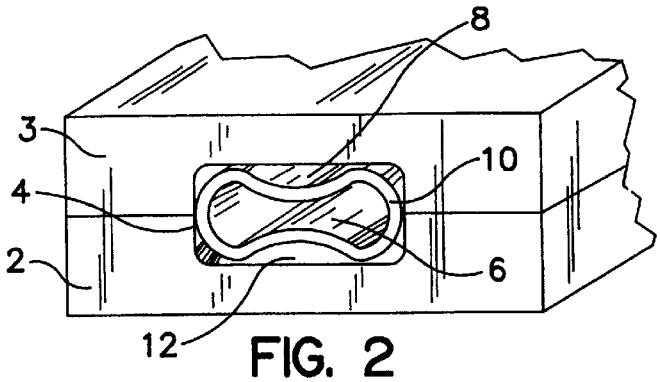
FIG. 2 PRIOR ART
FIG. 2 is a perspective view of the die of FIG. 1 in a closed position.

FIG. 2 shows the configuration of tube 4 once lower and upper die sections 2 and 3 are mated and tube 4 is stamped. Rather than conforming to the die cavity 8 formed by the mating of die sections 2 and 3, the tube wall 10 collapses and fails to conform to the shape of the interior walls 12 of die sections 2. Typically, then, after die stamping tube 4, a conventional hydroforming process is used, in which the pressure within tube interior 6 is increased beyond the yield strength of the material of tube 4, and tube 4 is forced to conform to the die cavity 8.

Figure 2A:
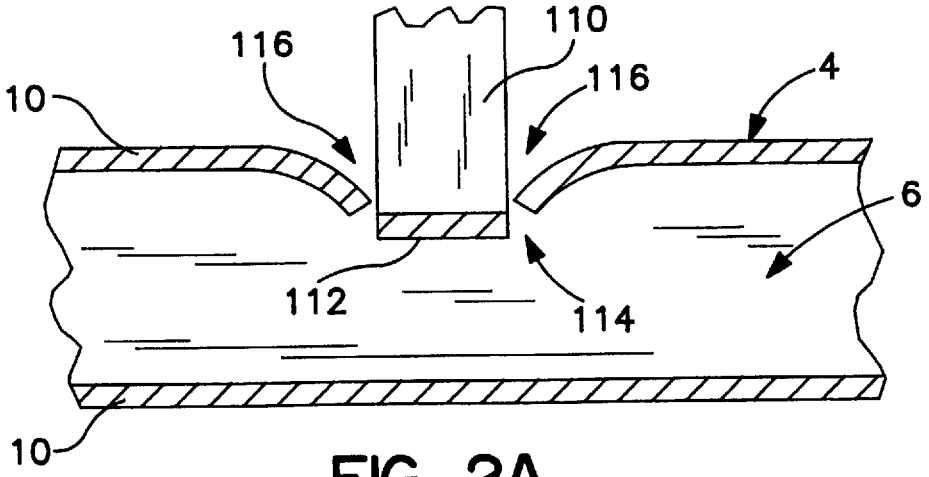
FIG. 2A PRIOR ART
FIG. 2*a* is a cross-sectional view of a prior art method wherein a tube is pierced by a punch to form a hole.

FIG. 2*a* shows tube 4 pierced by a punch 110 to form slug 112 and define hole 114. As used herein, "piercing" includes lancing, punching, or equivalent methods of creating a hole; and "hole" includes any type of hole created by piercing, such as a pierced-and-extruded hole or a lanced-tab hole. The interior 6 of the prior art tube does not contain any solid. Because tube wall 10 is not backed up during the punch process, tube wall 10 deforms in the area 116 surrounding hole 114. This forms an unacceptable, poorly defined, deformed hole 114.

II. Present Invention

A. Die-Stamping a Solid-Filled Tube

In a first embodiment of the present invention a solid-filled tube is die-stamped to cold form the tube to a non-cylindrical shape. The process includes the following steps: First, a tube is filled with a liquid change-of-state material. Second, the liquid change-of-state material is frozen to form a solid-filled tube. Third, the solid-filled tube is sealed. Fourth, the solid-filled tube is stamped in a die to form a stamped member. Finally, the change-of-state material within the stamped member is melted and drained from the formed, stamped member. These steps will be discussed in more detail in the above-listed order.

1. Filling a Tube with Change-Of-State Material

In the present invention, a tube is filled with a change-of-state material in liquid state at approximately atmospheric pressure prior to stamping the tube in a die. The change-of-state material can be either metallic or non-metallic and either solid or liquid at room temperature. However, the change-of-state material must have a melting point that is lower than the melting point of the tube material. Preferably the change-of-state material expands slightly to help prevent the formation of voids or air spaces in the interior of the tube as the change-of-state material changes from liquid to solid, as discussed in more detail below. A preferred non-metallic change-of-state material is water, because it is inexpensive and readily available. If desired, additives such as lubricants, bactericides, or rust preventatives can be added to the water, as is known in the art. Other nonmetallic change-of-state materials include waxes and thermoplastics.

Suitable metallic change-of-state materials include lead-bismuth alloys such as those manufactured by the Cerro Metal Products Company of Bellefonte, Pennsylvania sold under the trademarks CERRO ALLOYS, CERROBEND, CERROBASE, CERROSAFE, or CERROCAST. These alloys are described in *CERRO ALLOY Physical Data● Applications and Bending Thin-Walled Tubing, Moldings and Extruded Shapes* published by Cerro Metal Products Company, both of which are incorporated herein by reference.

Figure 3:
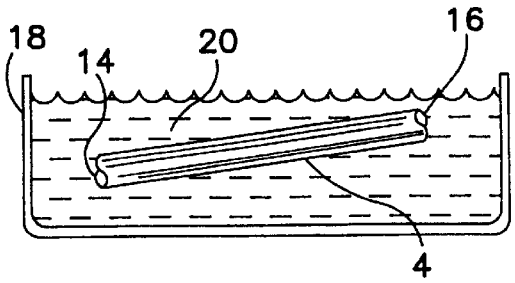
FIG. 3 is a side view of a tube submerged in liquid.

FIG. 3 shows a preferred method for fitting a tube with a change-of-state material that is normally in the liquid state at room-temperature, such as water. Tube 4 has open ends 14 and 16, and a given interior volume (not shown). Tube 4 is submerged in a tub or basin 18 containing liquid change-of-state material 20. Open end 16 is elevated relative to open end 14, so that as the air that is in the interior volume of the tube exits through elevated open end 16, the interior volume of tube 4 fills with liquid change-of-state material 20 entering through open end 14.

Preferably, when tube 4 is filled with a liquid change-of-state material that is normally a solid at room temperature, the liquid change-of-state material 20 gravity flows gently into tube 4 through open end 16, which is elevated relative to a closed end (not shown). This filling arrangement helps to avoid forming air locks in the interior of the tube.

A bulk member (shown as 136 in FIG. 7*b*) can be inserted in the interior of the tube 4 in order to reduce the amount of change-of-state material needed to fill the interior. The insertion of bulk member 136 into the interior reduces the amount of change-of-state material required to fill the tube, and thus lowers the amount of liquid that is subsequently frozen. Bulk member 136 is made of a flexible material that can be formed to be inserted into tube 4 while withstanding the temperatures and compressive forces during subsequent processing, and which is compatible with change-of-state material 20. Bulk member 136 can be made in wire, braid, or cable form. Preferably, bulk member 136 is positioned in the central position of the interior of tube 4.

2. Freezing the Change-Of-State Material

The change-of-state material within tube 4 is frozen prior to die stamping. If the change-of-state material 20 within tube 4 is of the type that expands upon freezing, then preferably it will expand outside of tube 4 through the open, uncapped end of the tube 4. In that case, tube 4 is placed in a vertical position while the change-of-state material solidifies. The solid change-of-state material that expands outside the open end of the tube 4 can be cut or sheared so that it is flush with the end of tube 4, prior to attachment of cap 22 to form sealed tube 30, as discussed below.

If the change-of-state material is normally a liquid at room temperature, the liquid-filled tube is placed in a freezer until the liquid freezes. Preferably, the liquid is completely frozen so that no voids or pockets of liquid or air remain. If water is used as the change-of-state material, then the temperature can be lowered to well below the 32° F. freezing point to assure that the liquid is completely frozen, and to allow for some warming during subsequent processing without melting the ice.

If the change-of-state material is normally a solid at room temperature, the tube filled with liquid change-of-state material can be quenched by lowering it into a cold-water tank (not shown) to cool the change-of-state material and quicken the freezing process. Also, the quenching process may be desirable to impart a fine-grained crystalline structure of high ductility to the change-of-state material, as is known in the art.

3. Sealing the Solid-Filled Tube

Figure 4:
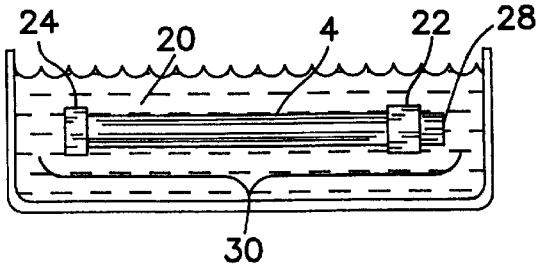
FIG. 4 is a side view of a liquid-filled sealed tube submerged in liquid.

Referring to FIG. 4, if the change-of-state material does not expand a significant amount during freezing, then the filled tube can be sealed full of liquid change-of-state material prior to freezing. One method of sealing tube 4, which is full of change-of-state material 20 that is normally liquid at room temperature, is by attaching caps 22 and 24 to the ends of tube 4 while the tube remains submerged, thus enclosing liquid change-of-state material 20 within tube 4. The caps must be attached to form a seal that can withstand the elevated pressures to which the tube can be subjected later in the process.

Figure 4A:
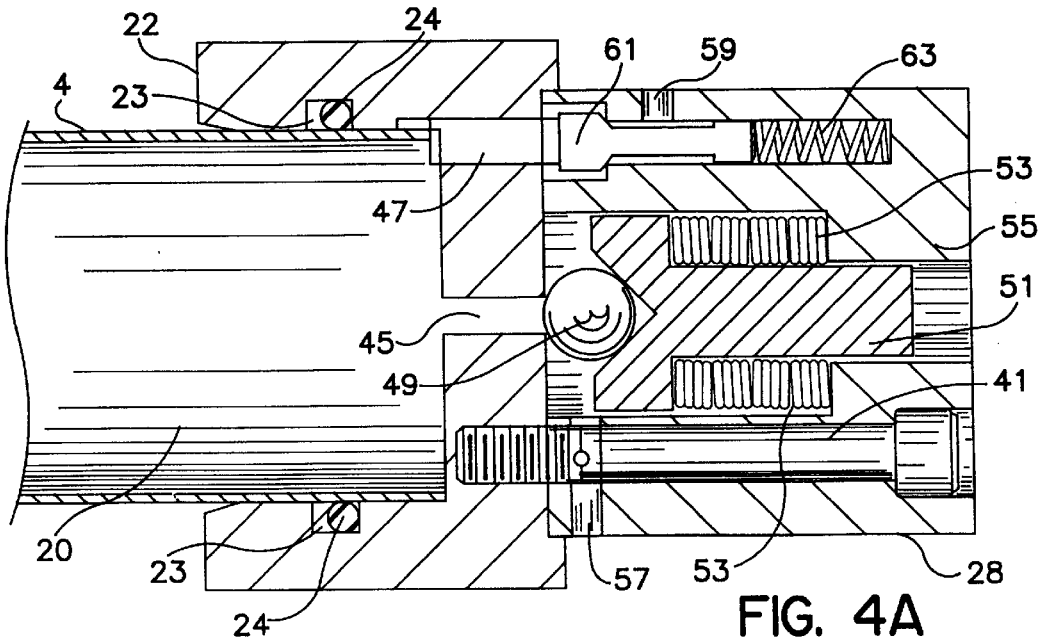
FIG. 4*a* is a side, cross-sectional view of the cap and relief valve of FIG. 4.

Methods of attaching a cap to the end of a tube to form a pressure-tight seal are known in the art. A preferred method of attaching the caps is shown in FIG. 4*a*. Cap 22, which has an interior groove 23, encloses one end of tube 4. O-ring 24 is positioned within interior groove 23, preferably with some preload stress upon it, as is known in the art. O-ring 24 forms a seal between cap 22 and tube 4 to prevent the change-of-state material 20 within the interior of tube 4 from escaping during subsequent processing. Preferably, o-ring 24 is 3/16 inch in diameter, and is made of a hard rubber, for example 90-durometer nitrile rubber. Preferably, "backups" or nylon washers (not shown) are used in conjunction with o-ring 24, as is known in the art.

While using caps to seal tube 4 is the preferred sealing method, other methods known in the art for sealing tubes can be used. For example, the ends of the tube can be pinched and welded shut. Also, die sections can engage the tube ends to seal the tube.

Referring again to FIG. 4, relief valve 28 is attached to cap 22. After attachment of caps 22 and 24 to tube 4 and closure of relief valve 28, the interior of tube 4 is completely sealed or enclosed to form sealed tube 30, which is full of change-of-state material 20 at approximately atmospheric pressure.

4. Stamping the Solid-Filled Tube

Figure 5:
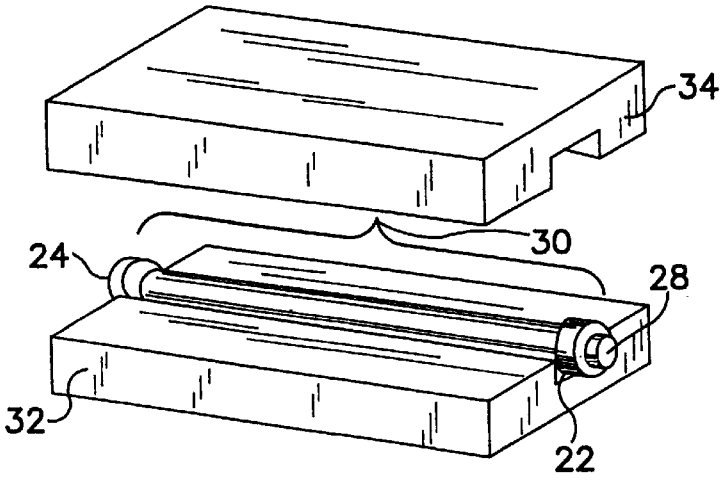
FIG. 5 is a perspective view of a liquid-filled sealed tube placed in an open die.

Referring to FIG. 5, sealed tube 30, which has an interior volume filled with solid change-of-state material at approximately atmospheric pressure, is shown positioned in lower die section 32 prior to the closure or mating of upper die section 34 with lower die section 32. While FIG. 5 shows a die that has an upper and a lower die section, the method of the present invention can be used with a die that contains more than two die sections, for example a die that also contains sidewall die sections, or with die sections that close horizontally rather than vertically. Gas springs (not shown) can be built into the die mold along with cam steels (not shown) to give added control during the cold forming process.

Figure 6:
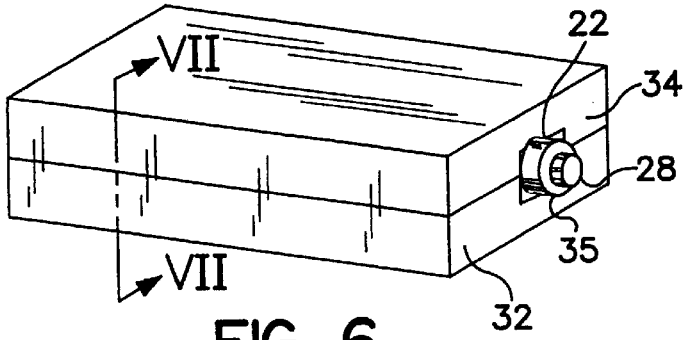
FIG. 6 is a perspective view of the die of FIG. 5 in a closed position.

FIG. 6 shows lower die section 32 and upper die section 34 in a closed or mated position, resulting in the die stamping of the sealed tube to form stamped member 35, which has a given exterior configuration and a given interior volume (not shown). The die stamping of the tube, that is, the stamping operation, can occur in one stamping step, or may require multiple stamping steps to completely form stamped member 35. Preferably, cap 24 (not shown) and pressure relief valve 28 (and thus indirectly cap 22) are held in place by die sections (not shown), to prevent caps 22 and 24 from moving or sliding off the end of the tube when the pressure within the tube increases during the stamping operation.

Figure 7A:
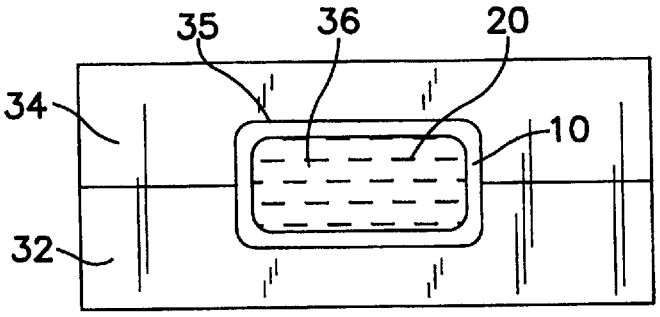
FIG. 7*a* is a sectional view taken along line VII—VII in FIG. 6 showing a stamped member filled with a solid change-of-state material.

FIG. 7*a* shows a cross section of the closed die of FIG. 6. Die sections 32 and 34 are mated to form die cavity 36, which has a given interior configuration. Preferably the sealed tube (not shown) has a circumference that is within about 95 to about 105 percent of the circumference of the die cavity 36, more preferably approximately equal to the circumference of the die cavity 36. However, the circumference of the sealed tube (not shown) prior to stamping can be as little as about 70 percent of the circumference of the die cavity 36 (i.e., the cross-sectional perimeter of the interior of the die cavity 36 formed by the mating of lower die section 32 and upper die section 34).

Figure 7B:
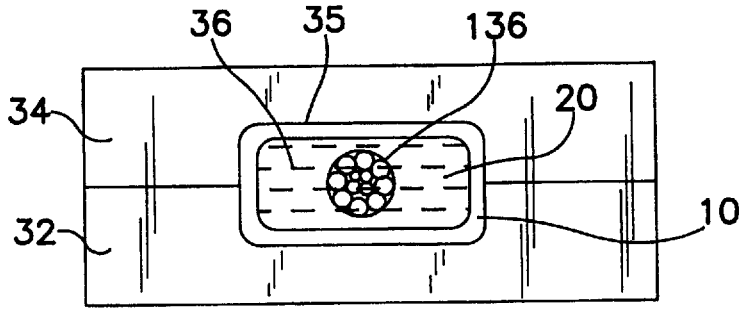
FIG. 7*b* is a sectional view taken along line VII—VII in FIG. 6 showing the solid-filled stamped member containing a bulk member.

FIG. 7*b* shows an alternative aspect of the present invention in which bulk member 136 is inserted in the interior 36 of tube 4 prior to freezing (solidifying) change-of-state material 20 and stamping it to form stamped tube 35, as previously discussed in Section II.A.1.

Figure 8:
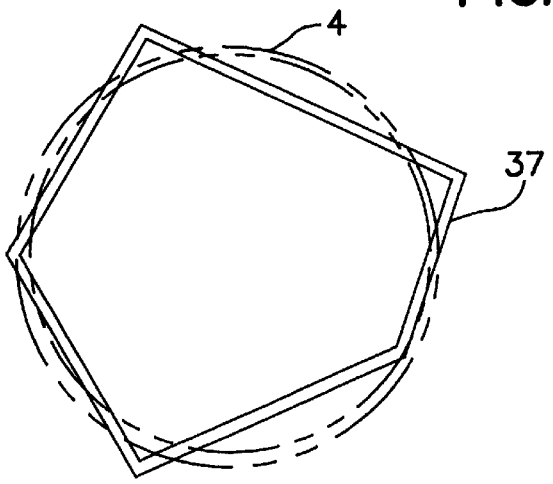
FIG. 8 is an end, cross-sectional view of a tube formed from an alternative die cavity configuration, juxtaposed with a cross-sectional view of a preformed tube.

While the die cavity 36 of FIGS. 7*a* and 7*b* is shown having a rectangular cross-sectional shape—and thus a box-shaped interior configuration—the die cavity could have other non-cylindrical or polygonal cross-sectional shapes to form other die cavity interior configurations. For example, FIG. 8 shows a cross-sectional view of stamped member 37, which has been stamped in a die cavity having a five-sided polygonal cross-sectional shape, juxtaposed with the cross-section of tube 4. While tube 4 is shown having a cylindrical shape or exterior configuration prior to stamping, typically tubes provided for stamping have a cross-section in the shape of a multi-sided polygon that approaches a circular shape, rather than an actual circular cross-sectional shape.

Figure 9:
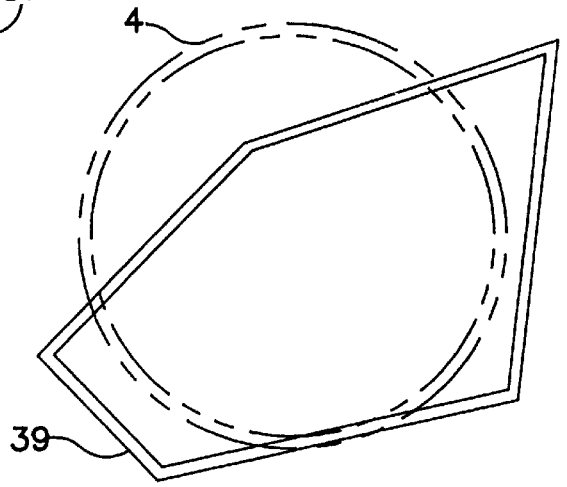
FIG. 9 is an end, cross-sectional view of a tube formed from another alternative die cavity configuration, juxtaposed with a cross-sectional view of a preformed tube.

In another example, FIG. 9 shows a cross-sectional view of stamped member 39, which has been stamped in a die cavity having an alternative five-sided polygonal cross-sectional shape. Stamped member 39 is also shown juxtaposed with a cross-section of tube 4.

Returning to FIG. 7*a,* the compressive forces generated as the die closes to form stamped member 35 also act to compress the solid change-of-state material 20 within the interior of the sealed tube as it changes shape. As the solid change-of-state material 20 resists compression, it forces the tube walls 10 outwardly toward the interior surface of the die cavity 36. Once die sections 32 and 34 have fully closed around the sealed tube, the tube walls 10 substantially conform to the interior walls of the die cavity 36, and the exterior configuration of stamped member 35 substantially conforms to the interior configuration of die cavity 36. "Substantially conforms" in this context means, for example, that the stamped tube basically reflects the shape of the die-cavity mold configuration, preferably with minimal deviation from the die-cavity mold configuration.

Because the interior volume of the sealed tube typically decreases as the die closes to stamp the tube into a non-cylindrically shaped stamped member 35, the volume of change-of-state material 20 in excess of the interior volume of the final stamped member 35 is released from the tube interior during the stamping process. This release is accomplished by use of pressure relief valve 28, shown in detail in FIG. 4*a*. The pressure relief valve 28 releases change-of-state material from within the sealed tube as the pressure rises above the relief pressure setting during mating of the upper and lower die sections. For example, when the change-of-state material is water, a fine "snow" or crystalline powder of ice is released. The relief pressure setting is determined by trial and error; the optimum relief valve setting is the lowest one that allows the tube to expand into the die corners while stamping, so that minimal energy is needed to stamp the tube. For most configurations, the pressure within the tube rises to a pressure that causes the tube walls to exceed their yield strength. For a tube made of 1010 or 1020 ERW commercial steel, and having a 2⅜ inch outer diameter and a 0.060 inch wall thickness, with water as the change-of-state material, the pressure relief setting is about 20,000 p.s.i.g.

Continuing with FIG. 4*a,* pressure relief valve 28 is attached directly to cap 22 by means of bolt 41. When cap 22 is used with pressure relief valve 28, cap 22 is constructed to define outlet port 45 and equalization port 47. Relief valve 28, shown in FIG. 4*a* in the closed position, has ball 49 resting against exit port 45, thus preventing the liquid 38 within tube 4 from passing through exit port 45. Positioner 51 holds ball 49 in place against outlet port 45. Springs 53 press against the interior of relief valve casing 55 and positioner 51, to force positioner 51 against ball 49. For the high relief-pressure settings required for the present invention (e.g., 20,000 p.s.i.g.) a series of spring washers works better than coil springs. The relief-pressure setting can be varied by adjusting the number and compression of the spring washers. Sixteen spring washers are sufficient for a relief-pressure setting of 20,000 p.s.i.g.

Relief valve casing 55 defines vent ports 57 and 59. The path between equalization port 47 and vent port 59 is blocked by piston 61, as shown in FIG. 4*a,* and thus piston 61 is in the closed position. When the internal pressure is relatively low (i.e., near atmospheric pressure), spring 63 presses against piston 61 to hold piston 61 in the open position (not shown), so that change-of-state material 20 can pass around piston 61 and through vent port 59. Thus, if cap 22 is attached to tube 4 while both are submerged in liquid change-of-state material, then the resistance against cap attachment caused by the compression of the liquid change-of-state material 20 within tube 4 can be eliminated. This facilitates the attachment of cap 22 to tube 4 when both are submerged in liquid change-of-state material. When the pressure of change-of-state material 20 rises above atmospheric pressure to press against piston 61 and overcome the force of spring 63 holding piston 61 open, then piston 61 moves to close the path around it, sealing exit port 59. When the compression of change-of-state material 20 rises to the point of forcing ball 49 to unseat from its position of blocking export 45 (i.e., reaches the relief-pressure setting), then change-of-state material 20 can pass through exit port 45 and vent port 57.

While the present invention works with only one pressure relief valve (i.e., pressure relief valve 28 attached to cap 22), for safety reasons a back-up or reserve pressure relief valve (not shown), set to release pressure at a higher setting than relief valve 28, may also be used. The reserve pressure relief valve may be attached to the cap at the opposite end of the tube (i.e., cap 24), similar to the manner in which relief valve 28 is attached to cap 22.

Cold forming a non-lubricated tube using the method of the present invention requires that the pressure relief valve be set high enough so that the compression reaches a minimum level within the interior of the tube. Typically in a cold forming process, the exterior of a tube is lubricated to decrease the resistance of the tube walls to conforming to the interior walls of the die cavity. However, if the formed tube piece is to be used as a structural component of an automobile, manufacturer specifications usually permit only water-soluble lubricants to be used to lubricate the tube. If the tube is submerged in water as the change-of-state material, any water-soluble lubricants may be dissolved. Without tube lubrication, the relief pressure setting should preferably be set to allow the compression within the sealed tube to rise to at least about 20,000 p.s.i.g. Otherwise, without tube lubrication, the walls of the sealed tube may not completely conform to the internal walls of the die cavity.

Figure 10:
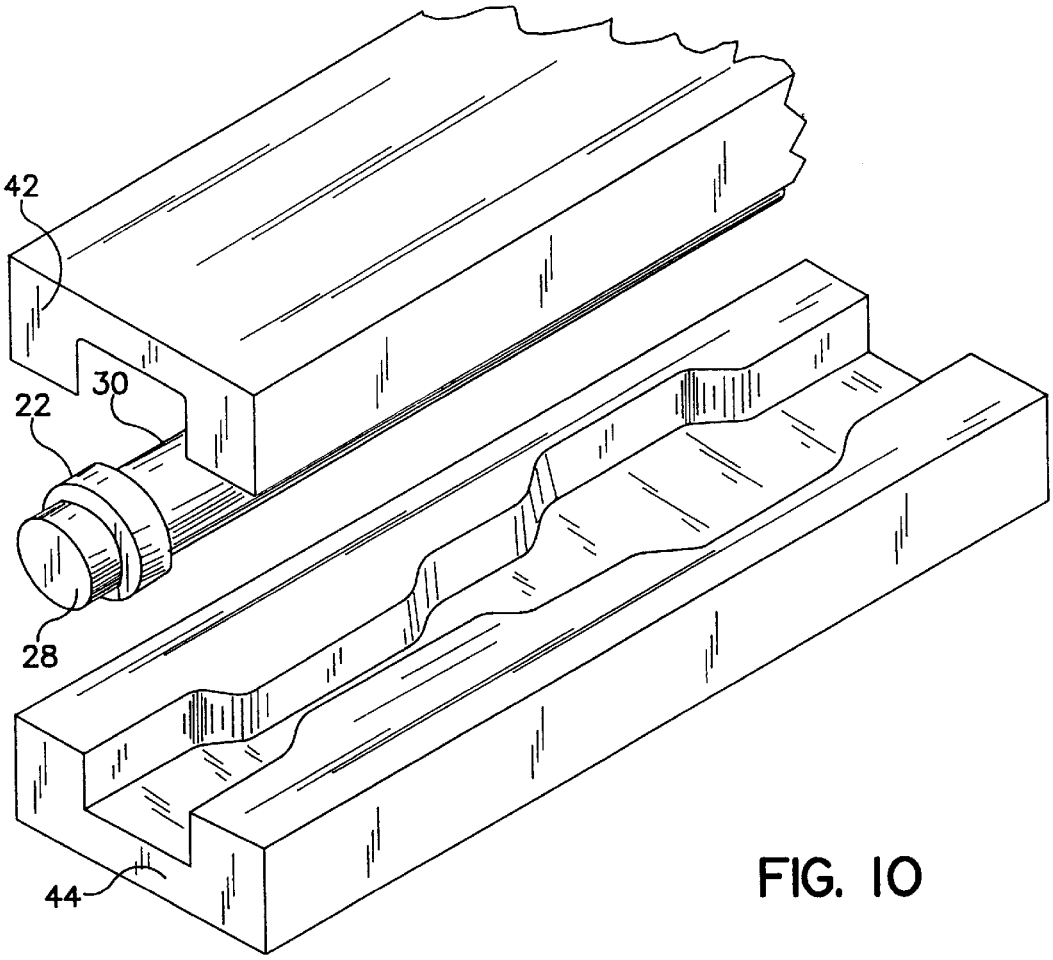
FIG. 10 is a perspective view of an alternative die in the open position showing an alternative die section configuration.

FIG. 10 shows an extended aspect of the present invention, in which the cross-sectional area of the die cavity, formed when upper die section 42 and lower die section 44 mate, varies along the length of the die cavity. When the die closes around sealed tube 30 filled with solid change-of-state material, some portions of the tube have their cross-sectional area contracted or restricted by the die sections during stamping. Other portions of the tube 30, which have a circumference smaller than the circumference of the die cavity, expand to conform to the interior die cavity wall. This expansion of the tube is caused by the compression increase in the change-of-state material generated when the upper and lower die sections 42 and 44 close to compress sealed tube 30. In some portions, the circumferential expansion of sealed tube 30 may be as high as about 30 to 40 percent of its original circumference, depending upon the wall thickness and material strength of tube 30. As with the previously discussed aspect of the present invention, the volume of change-of-state material that exceeds the interior volume of the final stamped member can be released from the interior of the tube during the stamping process through the use of pressure relief valve 28.

5. Melting and Draining the Change-Of-State Material

After die sections 32 and 34 have mated or closed to form stamped member 35, which has a non-cylindrical (e.g., polygonal cross-sectional) shape, the die is opened to release the stamped member 35. The caps 22 and 24 are removed.

Change-of-state material 20 is melted and drained from the stamped tube 35. If the change-of-state material is normally a liquid at room temperature, such as water, then the change-of-state material will melt as it seeks equilibrium with ambient conditions. If the change-of-state material is normally a solid a room temperature, then it can be heated to melt and drain. This can be accomplished, for example, by immersing the stamped tube containing the solid change-of-state material in a hot water tank. In either the normally liquid or normally solid change-of-state materials, the resulting melted liquid can be recovered and subsequently recycled for use filling subsequent tubes prior to freezing in order to provide an energy-efficient mode of operation. Alternatively, if the stamped member 35 is to have holes punched, then the solid change-of-state material can be retained within stamped member 35 during this subsequent processing, as described below.

If desired, the tube ends are finished using methods that are known in the art.

B. Piercing a Solid-Filled Tube

In a second embodiment of the present invention, a hole is formed in a tube by die punching a solid-filled tube. The method requires the following steps: First, a tube is filled with a liquid change-of-state material, which is frozen to form a solid-filled tube. Second, the solid-filled tube is pierced. Finally, the change-of-state material is melted and drained from the pierced tube.

1. Filling a Tube with a Solid Change-Of-State Material

Figure 11:
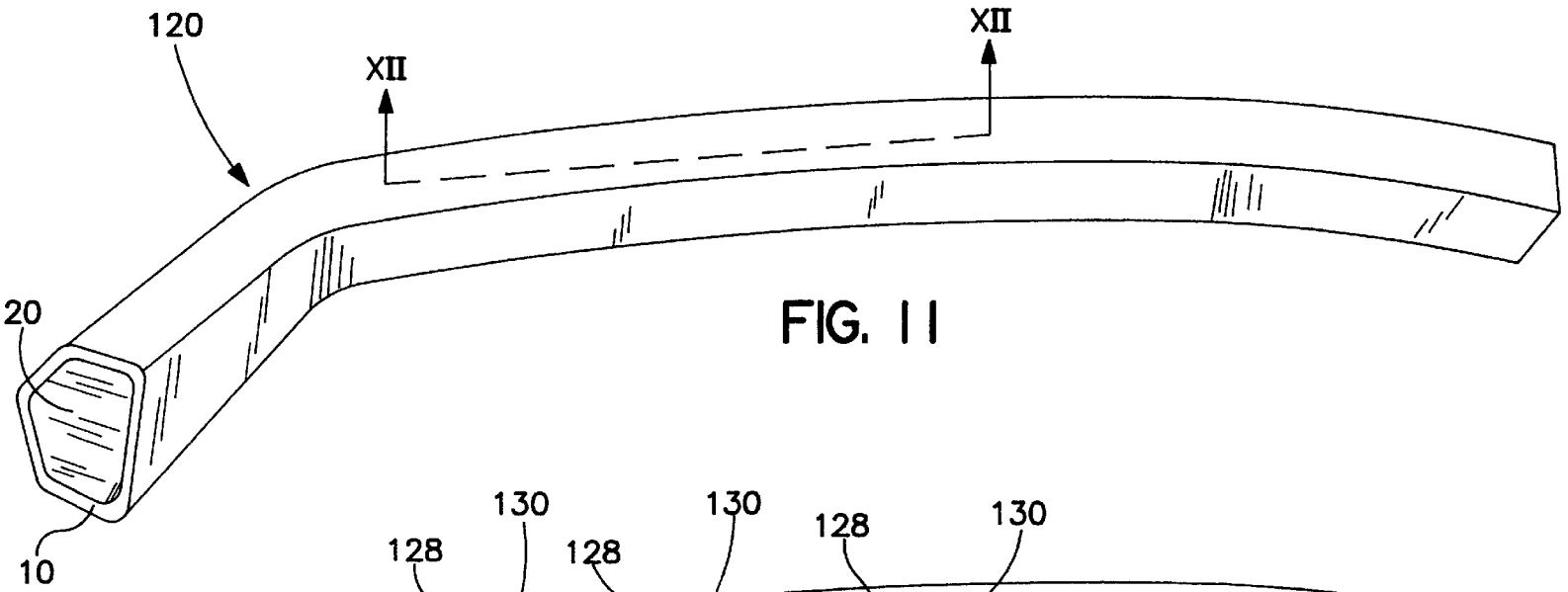
FIG. 11 is a perspective view of a stamped member filled with a solid change-of-state material.

A tube is filled with a liquid change-of-state material, which is subsequently solidified as previously described in Sections II.A.1&2. Referring to FIG. 11, the tube can be stamped to form stamped tube 120, as previously described. Although the caps have been removed from the ends of the stamped tube 120, the solid change-of-state material 20 has not been melted or drained.

2. Piercing the Solid-Filled Tube

Figure 12:
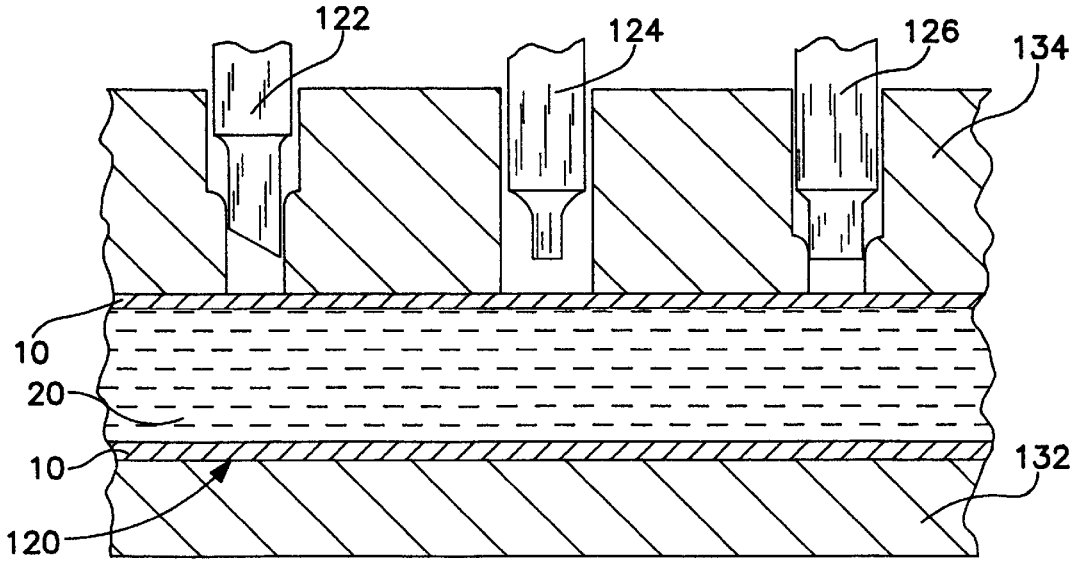
FIG. 12 is a sectional view taken along line XII—XII of FIG. 11 with the stamped member in the forming press and showing punches.

FIG. 12 shows a cross-section of the solid-filled, stamped member 120 prior to having holes formed in wall 10. The holes are pierced in the solid-filled, stamped tube 120 using conventional punch machinery. For example, if a lanced-tab hole is to be formed, then a punch having the configuration of punch 122 is used. If a pierced-and-extruded hole is to be formed, then a punch having the configuration of punch 124 is used. If a pierced hole is to be formed, then a punch having the configuration of punch 126 is used. Punches and their configurations are known in the art.

Figure 13:
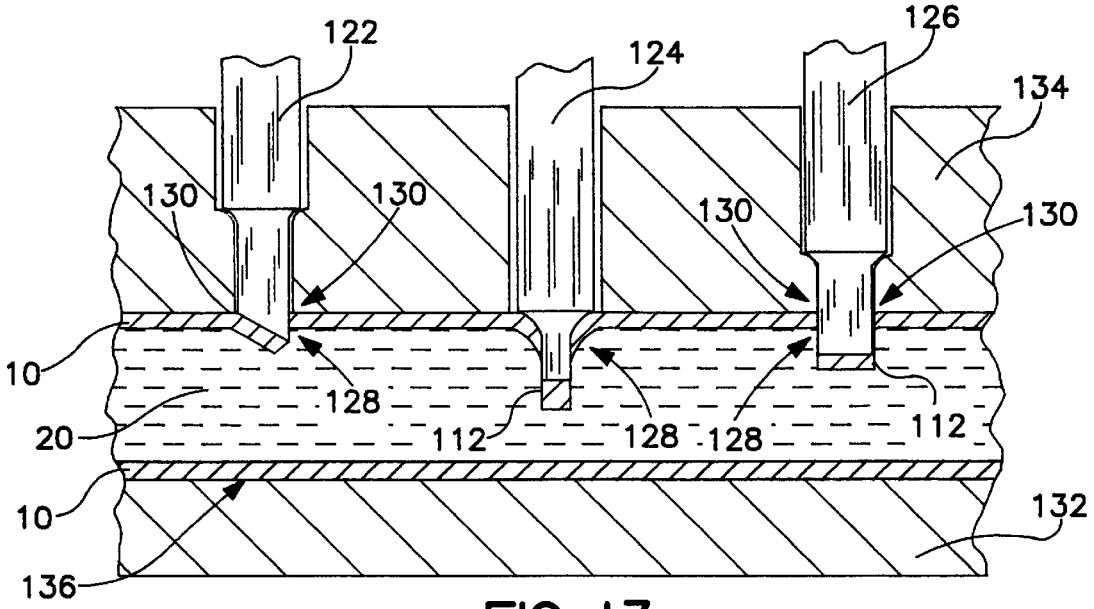
FIG. 13 is a sectional view similar to FIG. 12 showing the punches piercing the tube wall.

Referring to FIG. 13, punches 122, 124, and 126 pierce wall 10 of stamped member 120 to create holes 128. As these punches pierce wall 10, the solid change-of-state material 20 supports or "backs-up" wall 10. Therefore, while wall 10 can have some deformation in the area 130 surrounding wall 128, the amount of deformation is less than the amount of deformation in a comparable tube that is not solid-filled prior to piercing. As an illustration, the deformation in area 130 surrounding hole 128 of pierced solid-filled member 120 is less than the deformation in area 116 (FIG. 2*a*) of a tube pierced without a solid fill. (Of course, pierce-and-extrude punch 124 is designed to create a fixed amount of deformation or "draw" surrounding the hole, as is known in the art. However, this pierce-and-extrude hole follows the design of the punch much more readily when made in a tube having a solid-filling according to the present invention.)

Unless hole 128 is to be formed near the end of tube 120, there is no need to seal the ends of the tube, because the solid change-of-state material 20 within the tube 120 will perform a back-up or "mandril" function without being pushed out the end of the tube. However, if the hole 128 is to be formed near the end of a tube or stamped member 120, then preferably the end of the solid-filled tube is sealed by caps 22 or 24 or otherwise sealed, for example by supporting blocks 132 and 134.

3. Melting and Draining the Change-of-State Material

Figure 14:
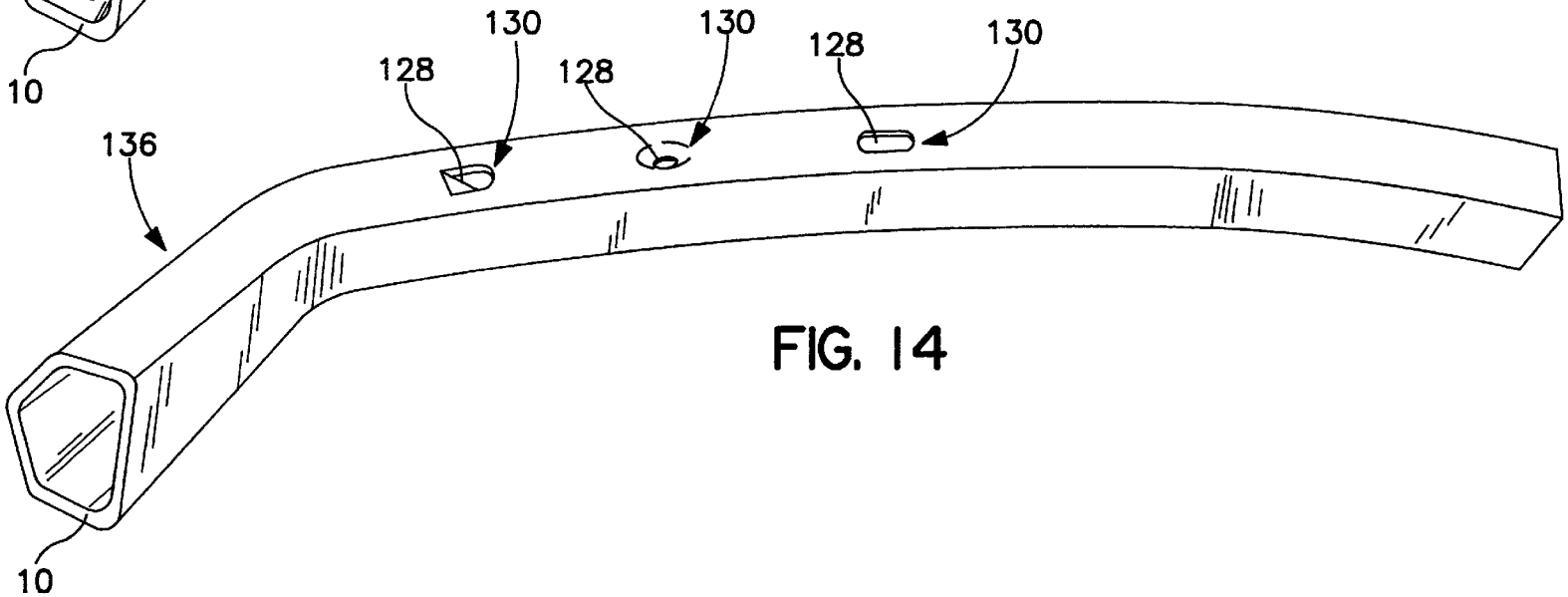
FIG. 14 is a perspective view of a pierced, stamped member formed according to the method of the present invention.

Turning to FIG. 14, the solid change-of-state material 20 is melted and drained from the interior of stamped and pierced member 136, as previously discussed in Section A.II.5. As previously discussed, if the forming and piercing operations are performed on the same tube, then preferably the forming or stamping of the solid-filled tube is followed by the piercing step.

C. Method of Making a Hole in an Outwardly Bulged Tube

In still another embodiment of the present invention, a tube is punched in an outwardly bulged area to define a hole. The method requires the following steps: First, a tube is formed to have an outwardly bulged area. Second, the formed tube is pierced in the outwardly bulged area to defme a hole. Simultaneously to the piercing step, the outwardly bulged area is depressed. The outwardly bulged area in the resulting pierced tube is substantially flattened.

1. Forming a Tube Having a Bulged Area

Figure 15:
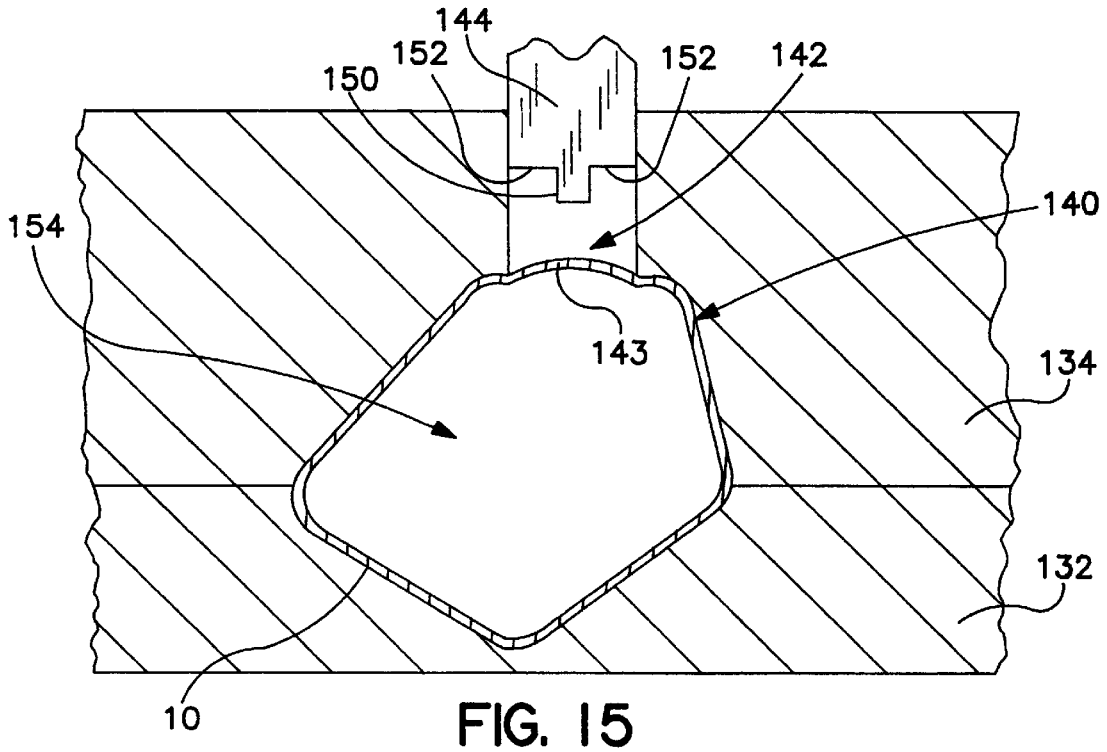
FIG. 15 is a cross-sectional view of a tube formed having an outwardly bulged area within a forming press.

Turning to FIG. 15, tube 140 has an outwardly bulged area 142 made up of wall portion 143. Wall portion 143 only extends throughout—that is, corresponds to—outwardly bulged area 142. Tube 140 can be formed to have outwardly bulged area 142 using the forming methods previously described or other methods known in the art. The extent to which outwardly bulged area 142 protrudes from tube 140 is determined by trial and error, and depends on factors such as the type and thickness of tube material to be punched, the configuration of the tube and hole, and the type and size of the punch. Typically to make a round, pierced hole, outwardly bulged area 142 has a diameter about 3 times the diameter of the pierced hole and extends outwardly at its peak about 75 percent of the distance that a bulge inwardly extends if the tube is pierced without having an outwardly bulged area.

Tube 140 is held in place by supporting blocks 132 and 134. Outwardly bulged area 142 is centered beneath punch 144, which has cutting portion 150 and flat portion 152.

2. Piercing the Outwardly Bulged Area

Figure 16:
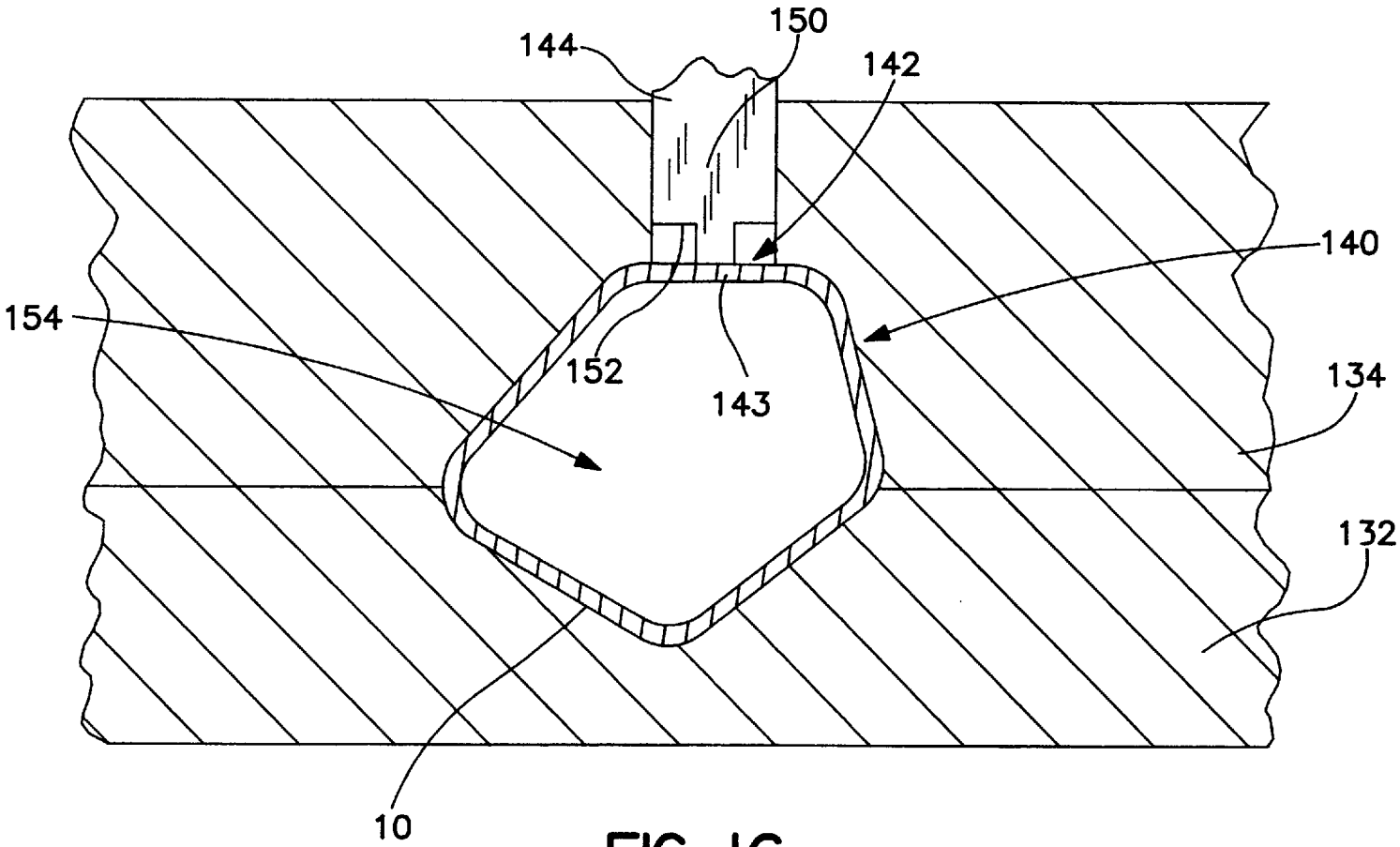
FIG. 16 is a cross-sectional view similar to FIG. 15 showing the outwardly bulged area partially pierced and depressed.

Referring to FIG. 16, the cutting portion 150 of punch 144 descends to contact outwardly bulged area 142. As the cutting portion 150 initially pierces wall portion 143, cutting portion 150 simultaneously depresses wall portion 143 of outwardly bulged area 142, forcing wall portion 143 toward the interior 154 of tube 140. Cutting portion 150 continues to descend to simultaneously depress and pierce wall portion 143, until cutting portion 150 substantially flattens outwardly bulged area 142 and creates hole 148. In this context, "substantially flattens" can include curved-wall configurations, for example, by comparing the amount of inward or outward bulge surrounding hole 148 relative to the curvature of the area immediately surrounding the formerly outwardly bulged area. Supporting blocks 132 and 134 support wall 10 in its pre-pierced configuration in areas other than wall portion 143.

Figure 17:
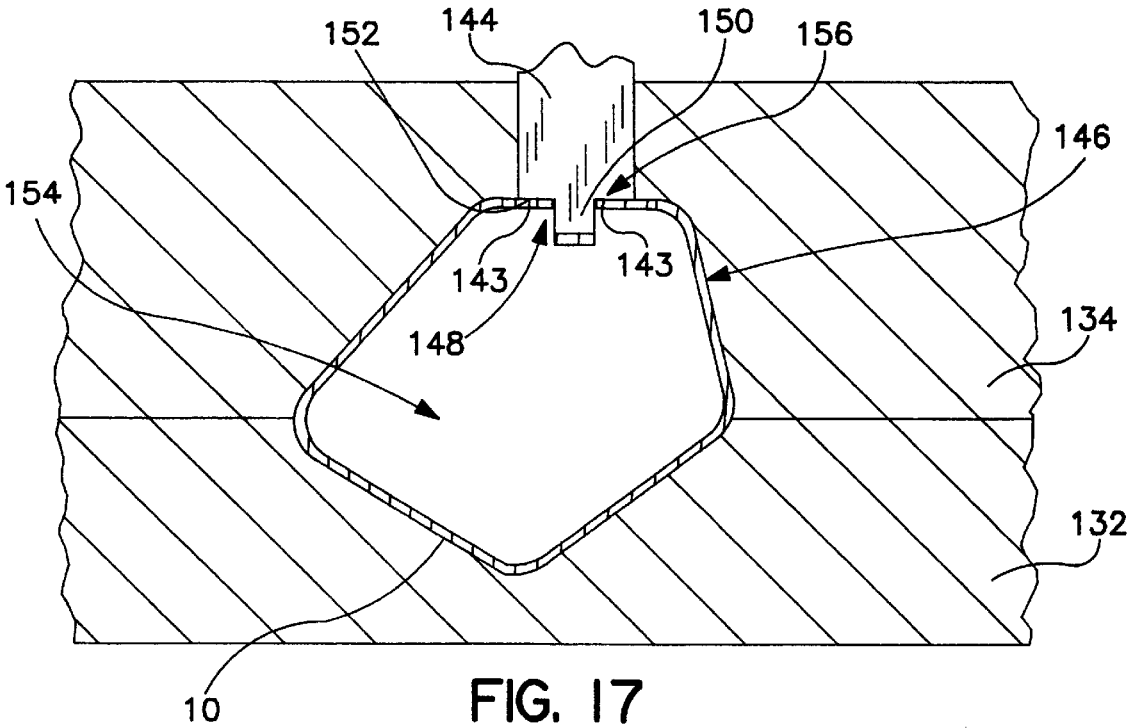
FIG. 17 is a cross-sectional view similar to FIG. 16 showing the outwardly bulged area pierced and flattened.

Turning to FIG. 17, pierced tube 146 defines hole 148 created by cutting portion 150 of punch 144. The area 156 surrounding hole 148 has less deformation than a comparable tube pierced without having first formed outwardly bulged area 142 (FIG. 15). As an illustration, compare pierced tube 146 of FIG. 17—formed according to the present invention—with tube 4 of FIG. 2*a,* which was pierced without first having formed an outwardly bulged area.

In an extended aspect of the present invention, a compressing step—subsequent to the simultaneous piercing and depressing steps—substantially flattens the outwardly bulged area. For example, after the cutting portion 150 of punch 144 has pierced tube wall 143, punch 144 extends to the bottom of its stroke to contact flat portion 152 of punch 144 with area 156 surrounding hole 148. This contact further compresses tube wall 143 to assure that it is substantially flat, as discussed above.

The outwardly bulged area 142 of tube 140 can be pierced and depressed while filled with liquid or solid, as previously described. Preferably, however, tube 140 is simultaneously pierced and depressed while "empty"—that is, outwardly bulged area 142 of tube 140 is pierced and depressed without a liquid or solid filling. This provides the advantage of creating pierced tube 146 without the additional steps and expense of filling and/or sealing the tube to contain a liquid or solid.

The above descriptions are those of preferred embodiments of the invention. Various alterations and changes can be made without departing from the spirit and broader aspects of the invention as defined in the claims, which are to be interpreted in accordance with the principles of patent law, including the doctrine of equivalents.

The embodiments of the invention in which an exclusive property or privilege is claimed are defined as follows:

1. A method of cold forming a metal tube comprising:

filling a tube with a change-of-state material comprising water having a melting point lower than the melting point of the tube, the change-of-state material being in a liquid state;

freezing the change-of-state material to form a solid-filled tube;

sealing the solid-filled tube;

stamping the solid-filled tube in a die to form a stamped member;

melting the change-of-state material within the stamped member; and draining the change-of-state material from the stamped member.

2. The method of claim 1 wherein the die includes a die cavity and the stamping step substantially conforms the exterior of the stamped member to the interior of the die cavity.

3. The method of claim 1 wherein the sealing step includes capping the tube with caps.

4. The method of claim 3 wherein die sections hold the caps in sealing engagement with the tube during the stamping step.

5. The method of claim 1 further comprising releasing a portion of the change-of-state material within the tube during the stamping step.

6. The method of claim 5 wherein the released portion is approximately equal to the difference between the internal volume of the tube and the internal volume of the stamped member.

7. The method of claim 5 wherein a pressure relief valve releases a portion of the change-of-state material.

8. The method of claim 7 wherein the pressure relief valve is secured to a cap.

9. The method of claim 8 wherein a die section holds the pressure relief valve on the cap during the stamping operation.

10. The method of claim 1 wherein the change-of-state material expands when freezing.

11. The method of claim 1 wherein the circumference of the stamped member at a given point is within about 95 to about 105 percent of the circumference of the tube at a corresponding point.

12. The method of claim 1 wherein the circumference of the stamped member is approximately equal to the circumference of the tube.

13. The method claim 1 wherein the circumference of the stamped member varies longitudinally.

14. The method of claim 1 further comprising inserting a bulk member in the tube prior to said freezing step, thereby reducing the amount of change-of-state material required to fill the tube.

15. The method of claim 12 wherein the bulk member comprises a flexible material having a form selected from the group consisting of wire, braid, and cable.

16. A method of cold forming a metal tube comprising:

filling a tube with a change-of-state material comprising water in liquid state;

freezing the change-of-state material to form a solid-filled tube;

sealing the solid-filled tube with caps, at least one cap including a pressure relief valve secured to the cap;

stamping the solid-fied tube in a die having die sections that hold the caps in sealing engagement with the tube during the stamping step to form a stamped member;

releasing with the pressure relief valve a portion of the change-of-state material within the tube during the stamping step approximately equal to the difference between the internal volume of the tube and the internal volume of the stamped member;

melting the change-of-state material within the stamped member; and draining the change-of-state material from the stamped member;

wherein the circumference of the stamped member at a given point is within about 95 to about 105 percent of the circumference of the tube at a corresponding point.

17. The method of making a pierced, formed tube comprising:

filling a tube with a change-of-state material in liquid state, said change-of-state material having a melting point lower than the melting point of the tube;

freezing the change-of-state material to form a solid-filled tube;

sealing the solid-filled tube;

stamping the solid-filled tube in a die to created a formed tube;

piercing the solid-filled formed tube to create a pierced, formed tube;

melting the change-of-state material within the pierced, formed tube; and draining the change-of-state material from the pierced, formed tube.

* * * * *

UNITED STATES PATENT AND TRADEMARK OFFICE

CERTIFICATE OF CORRECTION

PATENT NO. : 5,813,266

DATED : September 29, 1998

INVENTOR(S) : Stanley P. Ash

It is certified that error appears in the above-indentified patent and that said Letters Patent is hereby corrected as shown below:

Title page:

In the Abstract:
Line 16
"sinultaneously" should be --simultaneously--

Column 14, Line 23:
"solid-fied" should be --solid-filled--

Signed and Sealed this

Twenty-third Day of March, 1999

*Attest:*

Q. TODD DICKINSON

*Attesting Officer*

*Acting Commissioner of Patents and Trademarks*